US008671462B2

(12) United States Patent
Garcia et al.

(10) Patent No.: US 8,671,462 B2
(45) Date of Patent: Mar. 18, 2014

(54) STAB RESISTANT KNIT FABRIC HAVING BALLISTIC RESISTANCE MADE WITH LAYERED MODIFIED KNIT STRUCTURE AND SOFT BODY ARMOR CONSTRUCTION CONTAINING THE SAME

(75) Inventors: Alejandro Garcia, Hickory, NC (US); Matthew Kolmes, New York, NY (US)

(73) Assignee: Nathaniel H. Kolmes, Hickory, NC (US)

( * ) Notice: Subject to any disclaimer, the term of this patent is extended or adjusted under 35 U.S.C. 154(b) by 122 days.

(21) Appl. No.: 12/685,879

(22) Filed: Jan. 12, 2010

(65) Prior Publication Data

US 2011/0167545 A1 Jul. 14, 2011

(51) Int. Cl.

| | |
|---|---|
| ***F41H 1/02*** | (2006.01) |
| ***A41D 1/04*** | (2006.01) |
| ***A41D 27/12*** | (2006.01) |
| *F41H 1/00* | (2006.01) |

(52) U.S. Cl.
USPC ..... 2/2.5; 2/455; 2/456; 2/92; 2/97; 2/102

(58) Field of Classification Search
None
See application file for complete search history.

(56) References Cited

U.S. PATENT DOCUMENTS

| | | | | |
|---|---|---|---|---|
| 2,879,654 | A * | 3/1959 | Evans | 66/176 |
| 5,119,512 | A * | 6/1992 | Dunbar et al. | 2/167 |
| 5,628,172 | A * | 5/1997 | Kolmes et al. | 57/210 |
| 5,632,137 | A * | 5/1997 | Kolmes et al. | 57/212 |
| 6,155,084 | A * | 12/2000 | Andrews et al. | 66/174 |
| 6,962,739 | B1 * | 11/2005 | Kim et al. | 428/47 |
| 7,100,352 | B2 * | 9/2006 | Robins | 57/210 |
| 2002/0073473 | A1 * | 6/2002 | Bachner et al. | 2/2.5 |
| 2005/0009424 | A1 * | 1/2005 | Hazan et al. | 442/50 |
| 2006/0014016 | A1 * | 1/2006 | Lardizabal et al. | 428/375 |
| 2008/0289087 | A1 * | 11/2008 | Sundnes | 2/456 |
| 2009/0311930 | A1 * | 12/2009 | Wang et al. | 442/134 |
| 2010/0050699 | A1 * | 3/2010 | Kolmes et al. | 66/174 |
| 2010/0175430 | A1 * | 7/2010 | Garcia et al. | 66/174 |
| 2010/0227143 | A1 * | 9/2010 | Mulholland | 428/220 |
| 2010/0263109 | A1 * | 10/2010 | Noerenberg et al. | 2/456 |
| 2011/0004970 | A1 * | 1/2011 | Okamoto | 2/69 |

* cited by examiner

*Primary Examiner* — Bobby Muromoto, Jr.
(74) *Attorney, Agent, or Firm* — Oblon, Spivak, McClelland, Maier & Neustadt, L.L.P.

(57) ABSTRACT

A stab resistant knit fabric, made containing a plurality of panels of a knit fabric having a modified knit structure corresponding to rows of knit stitches, wherein each of the panels of knit fabric comprise a front layer of knit fabric and a back layer of knit fabric, wherein the front layer and back layer are joined together by rows of tuck stitches formed from a yarn having no more than 4.5% elongation; wherein at least one panel of knit fabric is arranged such that the rows of knit stitches of the at least one panel of knit fabric are perpendicular to the rows of at least one other panel of knit fabric, its combination with a ballistic layer to provide ballistic resistance properties, and a protective garment prepared therefrom.

33 Claims, 4 Drawing Sheets

STAB RESISTANT KNIT FABRIC HAVING BALLISTIC RESISTANCE MADE WITH LAYERED MODIFIED KNIT STRUCTURE AND SOFT BODY ARMOR CONSTRUCTION CONTAINING THE SAME

CROSS-REFERENCE TO RELATED APPLICATIONS

The present application is related to U.S. application Ser. Nos. 12/538,218 and 12/206,834, filed Aug. 10, 2009 and Sep. 9, 2008, respectively, the entire contents of which are hereby incorporated by reference.

BACKGROUND OF THE INVENTION

1. Field of the Invention

The present invention relates to a stab resistant knit fabric made with a layered modified knit structure which also has ballistic resistance properties, and a soft body armor construction containing the same.

2. Description of the Related Art

In many industries and professions there is a need for protective wear that is cut and/or abrasion resistant, yet lightweight and comfortable for the wearer. From maintenance workers crawling through HVAC ventilation shafts to weekend warriors participating in various sporting events to police officers having to confront knife wielding assailants, many individuals need protection from cuts and scrapes as they go about their daily activities.

Typical examples of previous garments and modular systems are disclosed in U.S. Publication No. 2004/0199983 to Gillen; U.S. Pat. No. 6,892,392 to Crye; U.S. Pat. No. 6,698,024 to Graves; U.S. Pat. No. 6,263,509 to Bowen; U.S. Pat. No. 6,185,745 to Alger; U.S. Pat. No. 6,182,288 to Kibbee; U.S. Pat. No. 6,158,056 to Riley; U.S. Pat. No. 6,029,270 to Ost; U.S. Pat. No. 5,894,600 to Chenefront; U.S. Pat. No. 5,754,982 to Gainer; U.S. Pat. No. 5,718,000 to Ost; U.S. Pat. No. 5,717,999 to Luny; U.S. Pat. No. 5,673,836 to Bush; U.S. Pat. No. 5,584,737 to Luhtala; U.S. Pat. No. 5,495,621 to Kibbee; U.S. Pat. No. 5,072,453 to Widder; U.S. Pat. No. 5,060,314 to Lewis; U.S. Pat. No. 4,497,069 to Braunhut; and U.S. Pat. No. 4,467,476 to Herbert, the disclosures of which are incorporated by reference herein in their entirety.

However, these and other known such garments suffer from numerous disadvantages. The garments are often unable to provide a satisfactory level of protection to a wearer of the garment, are easily damaged, are unwieldy and uncomfortable to the wearer, do not permit airflow therethrough, do not permit the escape of excess water vapor from the skin of the wearer, and often require the use of specialized over- or undergarments. Most of the modular systems in these patents require a central vest portion to be present in order to attach the other parts of the system.

In many activities, it is desirable to provide protective garments, including undergarments, to protect participants from being cut. In the law enforcement and security arenas, it is also desirable for protective garments to provide protection against stabbings. Stab resistance is not the same as puncture resistance. In particular, puncture resistance requires the garment to resist the insertion of a blunt or pointed object between the threads, but does not require cut resistance in addition. Stab resistance, on the other hand, requires an initial puncture resistance (for the tip of the knife or other sharp instrument) combined with the ability to resist the edge of the knife cutting its way through the fabric as force is applied.

Ideally, such garments should be flexible, pliable, soft and cut/abrasion resistant. Unfortunately, any improvement in the cut and/or abrasion resistance has usually been at the sacrifice of the other properties, usually resulting in bulky, uncomfortable garments.

Another desired property is ballistic properties, namely the ability to resist penetration by a bullet, particularly those fired from handguns at close range. Most ballistic wear is also overly bulky for the wearer.

In response to these problems, non-metallic cut-resistant yarns have been developed. These yarns have been described in U.S. Pat. Nos. 5,177,948 and 5,845,476 to Kolmes et al., the contents of these patents are incorporated herein by reference. Kolmes '948 describes a yarn having substantially parallel core strands which may include fiberglass. Kolmes '476 describes other non-metal containing yarn constructions which contain fiberglass as a core yarn.

Common metal mesh products are marketed to provide cut, slash and laceration protection, but often are insufficient in puncture resistance, due to the holes in the mesh.

Accordingly, a modified knit structure fabric is needed that can provide stab resistance. Additionally, a less bulky fabric that can provide ballistic resistance in addition to the stab resistance is also needed.

SUMMARY OF THE INVENTION

One object of the present invention is to provide a knit garment made from a layered modified knit structure fabric that provides stab resistance for the wearer. A further object of the present invention is to provide such a knit garment that also provides puncture, cut and abrasion resistance.

A further object of the present invention is to provide a soft body armor formed from the knit garment.

Another object of the present invention is to provide a soft body armor having a combination of stab resistance and ballistic resistance properties.

These and other objects of the present invention, either individually or in combinations thereof, have been satisfied by the discovery of a stab resistant knit fabric, comprising:

a plurality of panels of a knit fabric having a modified knit structure corresponding to rows of knit stitches, wherein each of the panels of knit fabric comprise:

a front layer of knit fabric and a back layer of knit fabric, wherein the front layer and back layer are joined together by rows of tuck stitches formed from a yarn having no more than 4.5% elongation; wherein at least one panel of knit fabric is arranged such that the rows of knit stitches of the at least one panel of knit fabric are perpendicular to the rows of at least one other panel of knit fabric, and a soft body armor prepared from the fabric.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
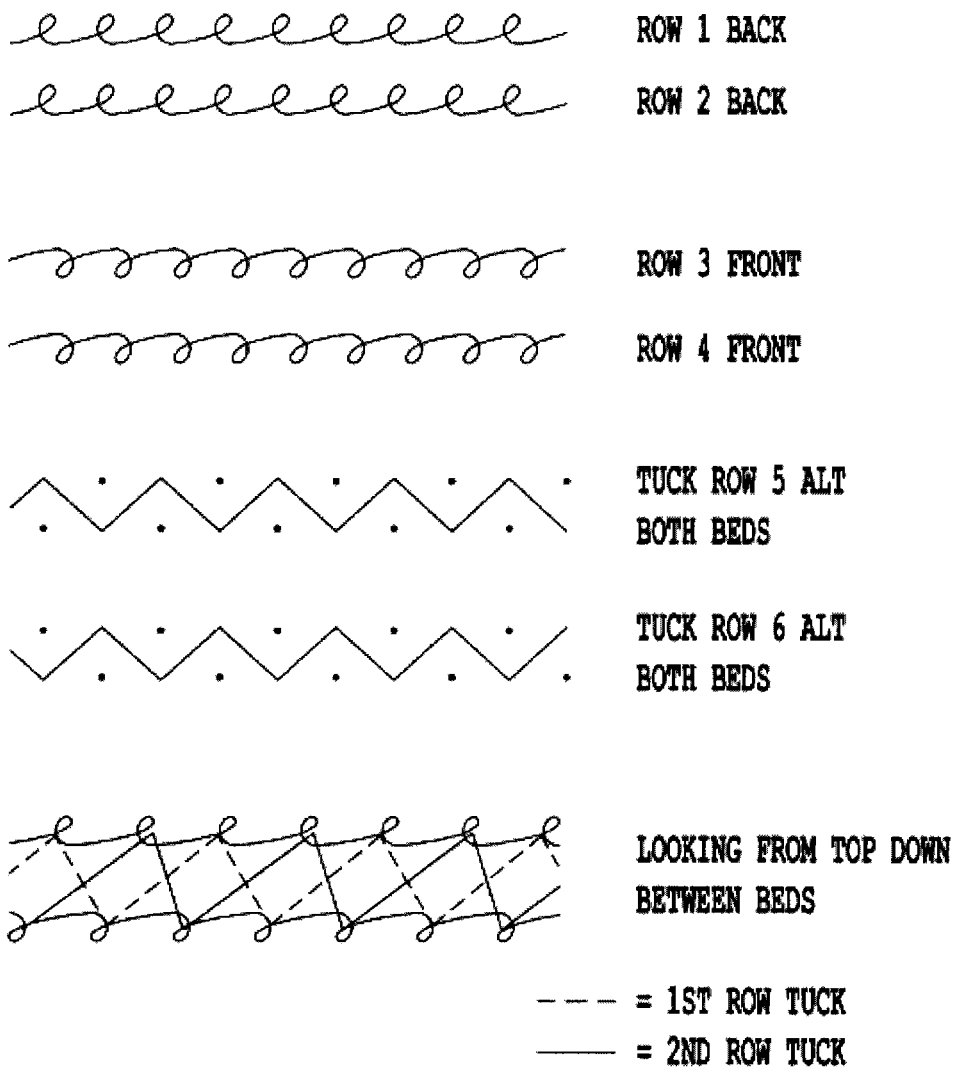
FIG. 1 shows an exemplary embodiment of modified knit stitch to prepare the knit fabric of the present invention.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "intimate blend" as used herein refers to a mixture of fibers of at least two types, wherein the mixture is formed in such a way that the individual filaments of each type of fiber are substantially completely intermixed with individual filaments of the other types to provide a substantially homogeneous mixture of fibers, having sufficient entanglement to maintain its integrity in further processing and use.

The term "stretch broken" as used herein refers to a process in which fibers are hot stretched and broken to produce short fiber lengths, rather than cutting, in order to prevent some of the damage done by the cutting process.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consists of a single strand. A "blended yarn" as used herein refers to a yarn that comprises an intimate blend of at least two different types of fibers.

The term "end" as used herein refers to a single yarn ply used in preparation of multi-end yarns. The two or more ends may be put together by twisting together, wrapping a cover wrap around the combined ends or by air-interlacing as described below.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. Nos. 4,777,789, 4,838,017, 4,936,085, 5,177,948, 5,628,172, 5,632,137, 5,644,907, 5,655,358, 5,845,476, 6,212,914, 6,230,524, 6,341,483, 6,349,531, 6,363,703, 6,367,290, and 6,381,940 (collectively, the "Kolmes patents"), the contents of each of which are hereby incorporated by reference.

The term "air interlacing" as used herein refers to subjecting multiple strands of yarn to an air jet to combine the strands and thus form a single, intermittently comingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the relevant portions of which are hereby incorporated by reference.

The term "composite fabric" is used herein to indicate a fabric prepared from two or more different types of yarn or composite yarn. The fabric construction can be any type, including but not limited to, woven, knitted, non-woven, etc. The two or more different types of yarn or composite yarn include, but are not limited to, those made from natural fibers, synthetic fibers and combinations thereof.

The term "composite article" is used herein to indicate a final article that comprises at least two different types of materials. The composite article can be prepared from a composite fabric, or can be prepared from a conventional fabric containing only one type of yarn, but is put together using a yarn or sewing thread made of a different material.

Alternatively, the conventional fabric can be sewn together using a composite yarn as the sewing thread. Composite articles can be any form, including but not limited to, gloves, aprons, socks, filters, shirts, pants, undergarments, one-piece jumpsuits, etc. All of these types of articles, as well as other permutations that are readily evident to those of skill in the art, are included in the present invention definition of "composite article".

For convenience, the term "yarn component" as used herein, encompasses fiber, monofilament, multifilament and yarn.

Often, in knit fabrics, puncture or stab resistance has been extremely difficult, if not impossible, to achieve due to knit stitches often being able to have mobility thus "robbing" yarn from adjacent stitches to open a hole in the fabric, without cutting or tearing the yarns. U.S. application Ser. Nos. 12/538,218 and 12/206,834, filed Aug. 10, 2009 and Sep. 9, 2008, respectively, provide puncture resistant knit fabrics, but do not address the production of stab resistant soft body armor. The entire contents of these applications is hereby incorporated by reference. Stab resistance requires a combination of puncture and cut/slash resistance not necessarily provided by the fabrics of these two prior applications.

The present invention modified knit structure fabric is preferably formed on a conventional two bed knitting machine, such as a flat bed knitting machine. The fabric has two layers of fully formed and separate knit fabric on the front and back beds. The type of knit fabric is not particularly important, although knit jersey is preferred due to simplicity. Two rows of the front and back panels of knit un-connected fabric are then attached by (2) rows of tuck stitches. The tuck stitches can be done on every needle, or on alternating needles in opposite directions. Preferably, the 2 rows of jersey on the back and 2 rows of jersey on the front are held together by tucks on needles 1,3,5,7 . . . etc. on a first row of each, followed by tucks on needles 2,4,6,8, . . . etc. on the second row of each—so all needles have been tucked on- then the cycle repeats. It is even possible to use 3 rows of every third needle, or 4 rows of every fourth needle, although these embodiments would tend to sacrifice puncture resistance relative to the alternating tuck stitch or every needle tuck stitch embodiments.

The tuck stitches can be made using any desired yarn, so long as the yarn has elongation that is low enough to prevent borrowing or "robbing" of yarn from adjacent stitches, permitting a hole to open up. Preferably, the tuck stitches have an elongation that is no more than 4.5%, more preferably no more than 4%, still more preferably no more than 3.75%, even more preferably no more than 3% elongation, further preferably no more than 2.5% elongation, still more preferably no more than 2% elongation, even more preferably no more than 1.5% elongation, still more preferably no more than 1% elongation, and most preferably no more than 0.5% elongation. In a most preferred embodiment, the tuck stitches are formed using a composite yarn that has essentially no elongation, to avoid the ability of stitches to "rob" yarn from one another, thus permitting a hole to open up.

With little or no elongation, the tuck stitches hold the knit fabric tightly together, providing the desired puncture resistance. The tuck stitch yarn can be the same or different from that used in the knit jersey front and back panels. Preferably, to obtain puncture, cut and abrasion resistance, the knit jersey and the tuck stitches are formed from at least one type of cut and abrasion resistant yarn, most preferably from a composite yarn that is cut and abrasion resistant.

FIG. 1 provides an exemplary preferred stitch pattern for use in the present invention showing (from top to bottom) two rows of knit jersey stitch in back, and two rows of knit jersey stitch in front, followed by two rows of alternating tuck stitches. The final portion of the figure shows the stitches looking from top down between the two beds, giving an indication of the interrelation between the jersey stitches and the tuck stitches.

Because these tucks are not formed knit stitches, there is no extra yarn to "rob" to expand a natural hole in this fabric from an awl, nail, or other pointy device that could normally penetrate knit fabric.

The resulting puncture resistant fabric can be made from any desired yarn, but is preferably made from high performance yarns, composite yarns, fiberglass, and other cut and abrasion resistant materials, in order to provide a knit fabric having not only cut and abrasion resistance, but also puncture resistance. Another advantage provided by the present invention modified knit structure is the ability to use high performance yarns or composite yarns having cut and abrasion resistance on a conventional knitting machine. In many cases, such high performance or composite yarns are not readily useable on flat bed knitting machines. With the present invention modified knit structure, this is not a problem.

The composite yarn used to prepare a preferred embodiment of the present invention knit fabric can be any composite yarn noted above in the definition of "composite yarn". However, a preferred embodiment uses a composite yarn having a core comprising parallel strands of a high performance yarn and fiberglass, with one or more wrap layers formed from a thermoplastic yarn (such as polyester or nylon) or a natural yarn (such as wool or cotton). In a more preferred embodiment, the core further comprises a strand of monofilament nylon or stainless steel wire, preferably of 0.006 in diameter. In a most preferred embodiment, the composite yarn comprises a core of 200 denier olefin (ultra high molecular weight polyethylene) yarn, G-450 fiberglass (nominally 100 denier), and a strand of either 0.006 monofilament nylon or stainless steel wire; with a first wrap layer of 150 denier polyester and a second wrap layer (wrapped in a direction opposite to the wrap direction of the first wrap layer) of 150 denier polyester. It is most preferred that the entire knit fabric be prepared from such a composite yarn, including the tuck stitches.

Figure 4:
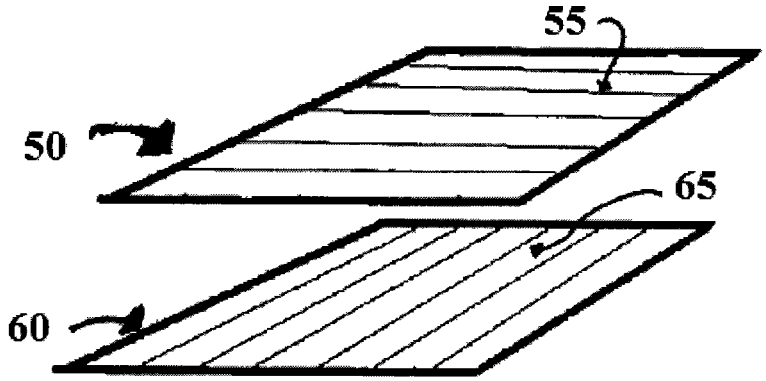
FIG. 4 provides a representation of two layers, 60 and 50, of the present invention knit fabric having the rows of stitches, 65 and 55, perpendicular to one another.

To then form the stab resistant knit fabric of the present invention, a plurality of layers of these knit fabrics are combined. Since knit fabrics generally have rows of stitches, in order to provide the desired stab resistance, it is necessary to rotate at least one first layer such that the rows of that first layer are arranged along a parallel plane but in a perpendicular direction relative to the rows of at least one other second layer. This arrangement is illustrated in FIG. 4. Preferably, the second layer 60 is adjacent to the first layer 50, but this is not required, so long as the rows of knit stitches (i.e. 65 and 55) are oriented perpendicular to one another between the layers. If more than two layers of knit fabric are combined in the present invention stab resistant knit fabric, it is only necessary to have one layer be perpendicular in arrangement to the others. However, in a preferred embodiment, each successive layer is arranged such that the knit rows are perpendicular to each layer adjacent to it.

Figure 2:
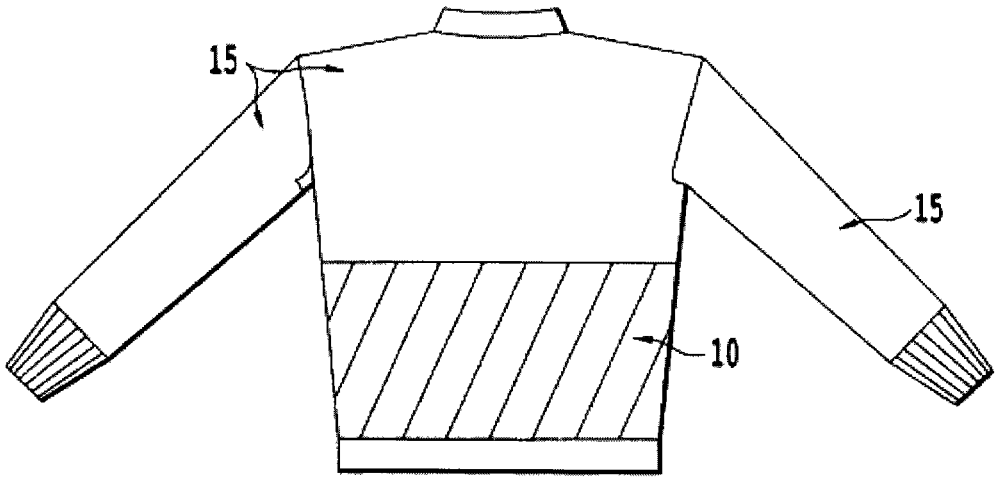
FIG. 2 shows a preferred embodiment of sweater/jacket having a panel made of the present invention puncture resistant knit fabric.

The stab resistant knit fabric of the present invention can be made into a variety of protective garments, such as aprons, gloves, shirts, pants, jumpsuits, vests, arm coverings, etc. Additionally, the stab resistant knit fabric of the present invention can form any part of or the entire garment, depending on the end use. In a preferred embodiment (see FIG. 2), the fabric is formed into a protective panel 10 in a sweater/jacket that is an integral combination where the top portion 15 can be any fabric or covering, such as leather, or a sweater/shirt having shaped knit sleeves in accordance with U.S. patent application Ser. No. 11/778,340, filed Jul. 16, 2007 (hereby incorporated by reference), most preferably with thumb loops (not shown) present at the cuffs for maintaining the sleeves protection on the full length of the arm without riding up the arm of the wearer. The back is preferably open from 2" below the arm holes where it ends in a cuff. FIG. 2 shows a preferred version of the sweater/jacket having the puncture resistant protective panel 10 in the front protecting the wearer from approximately the rib cage down to the waist. The sweater/jacket can also be extended in length providing additional protection down to knee or floor level if desired, by extending the front puncture resistant panel, while stopping the back at waist level.

Figure 3:
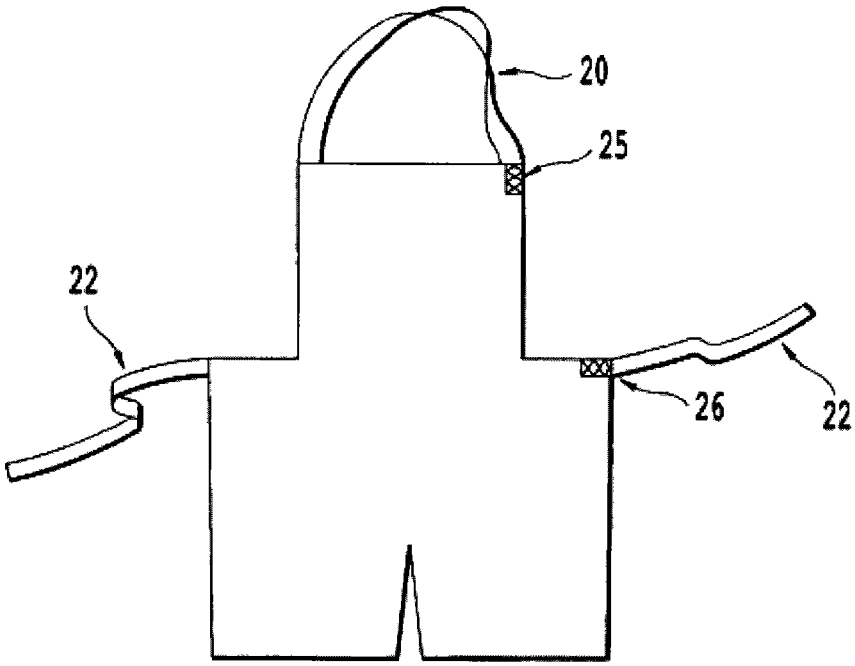
FIG. 3 shows a preferred embodiment apron formed from the present invention puncture resistant knit fabric.

In another embodiment, the present invention modified knit structure fabric is formed into an apron as shown in FIG. 3. In this preferred embodiment, the entire apron is made of the present invention stab resistant knit fabric (except for the neck sash 20 and the waist ties 22). Though any closure system can be used to keep the apron in place (such as ties, etc), there is most preferably a simple adjustable nylon web with hook-and-loop closure system to keep the apron in place. The closures 25 and 26, for the neck sash 20 and waist ties 22, respectively, are preferably made of a hook-and-loop closure system (such as VELCRO). This permits the wearer to secure the apron into place, but permits the apron to break loose should it get caught in machinery.

The front of the apron is made of the stab resistant knit fabric of the present invention from 2" below the arm holes and extends to the full length of the front of the apron. In a most preferred embodiment, the apron length extends to just below the knees of the wearer.

In a further preferred embodiment, the stab resistant knit fabric can be combined with a further ballistic layer to provide added protection from ballistic materials. Any conventional commercially available ballistic layer can be used, such as a Level IIIA ballistic panel (such as those sold by Miguel Caballero Ltd. of Columbia, South America) or Level IIA ballistic vest (such as those sold by Safariland, Ltd). The stab resistant knit fabric of the present invention can be provided either beneath the ballistic layer (between the ballistic layer and the wearer) or above the ballistic layer (with the ballistic layer between the wearer and the stab resistant knit fabric layers). Alternatively, one or more layers of the stab resistant knit fabric can be provided on each side, so long as at least one first layer of knit fabric has the knit rows arranged in a perpendicular arrangement relative to the knit rows of a second layer, either on the same side of the ballistic layer or opposite sides of the ballistic layer.

EXAMPLES

Layered Stab resistant knit fabrics were prepared from a yarn having the following components:

Core: parallel strands of 200 denier olefin (ultra high molecular weight polyethylene) yarn, G-450 fiberglass (nominal 100 denier), and 0.006 in diameter stainless steel wire First wrap layer: 150 denier polyester Second wrap layer: 150 denier polyester The samples were prepared having the following configurations and tested in accordance with NIJ 0115.00 (the contents of which are hereby incorporated by reference):

2 LAYER SAMPLE: Ballistic layer (Level IIIA ballistic panel obtained from Miguel Caballero Ltd) on top with protective side facing up towards the dropping knife blade, with 2 layers of the knit fabric underneath the ballistic layer. These 2 layers of knit fabric were oriented such that the relative directions of the knit rows were at 0 degrees and 90 degrees (i.e. the rows were perpendicularly arranged in parallel planes).

Testing of this sample achieved a rating of L1, E2 under NIJ 0115.00.

4 LAYER SAMPLE

Ballistic layer (Level IIIA ballistic panel obtained from Miguel Caballero Ltd) on top with protective side facing up towards the dropping knife blade, with 4 layers of the knit fabric of the present invention underneath the ballistic layer. These 4 layers of knit fabric were oriented such that the relative directions of the knit rows were at 0 degrees, 90 degrees, 0 degrees, and 90 degrees, respectively (i.e. each layer had the knit rows arranged perpendicularly to the rows of the adjacent layer(s)).

Testing of this sample achieved a rating of L2, E2 under NIJ 0115.00.

These are the standards required for "stab resistant" armor used by military and police.

BALLISTIC TEST

Four layers of the modified knit fabric of the present invention were combined with a level 2A ballistic vest (a low level ballistic vest) with the vest in front of the modified knit fabric. The resulting assembly was tested in accordance with NIJ 0101.06 (Ballistic Resistance of Body Armor), the entire contents of which are hereby incorporated by reference. Remarkably, this combination was found to stop a .357 caliber round fired at a velocity of 1430-1470 ft/sec, without penetration of the last of the knit layers, bringing the antiballistic level of the vest up to a Level 2 rating, and providing the above noted L2, E2 stab protection, a feat that was quite surprising given the low level ballistic vest used.

Obviously, numerous modifications and variations of the present invention are possible in light of the above teachings. It is therefore to be understood that within the scope of the appended claims, the invention may be practiced otherwise than as specifically described herein.

The invention claimed is:

1. A stab resistant knit fabric, comprising:

a plurality of panels of a cut and abrasion resistant knit fabric having a modified knit structure corresponding to rows of knit stitches, wherein each panel of knit fabric is arranged such that the rows of knit stitches of the panel are in a perpendicular direction relative to an adjacent panel of knit fabric, wherein each of the panels of cut and abrasion resistant knit fabric comprise:

a front layer of cut and abrasion resistant knit fabric and a back layer of cut and abrasion resistant knit fabric, wherein the front layer and back layer are joined together by rows of tuck stitches formed from a yarn having no more than 3.75% elongation, to avoid borrowing of yarn from adjacent areas and thus avoid having a hole open up, wherein the rows of tuck stitches are rows of alternating tuck stitches; wherein at least one panel of knit fabric is arranged such that the rows of knit stitches of the at least one panel of knit fabric are perpendicular to the rows of at least one other panel of knit fabric, wherein the front layer and back layer are each a knit jersey layer.

2. The stab resistant knit fabric of claim 1, wherein one or both of the front layer and back layer comprise one or more composite yarns.

3. The stab resistant knit fabric of claim 1, which comprises 2 panels of knit fabric.

4. The stab resistant knit fabric of claim 1, which comprises 3 panels of knit fabric.

5. The stab resistant knit fabric of claim 1, which comprises 4 panels of knit fabric.

6. The stab resistant knit fabric of claim 1, which comprises 5 panels of knit fabric.

7. The stab resistant knit fabric of claim 1, which comprises 6 panels of knit fabric.

8. The stab resistant knit fabric of claim 1, further comprising a ballistic panel layered with the plurality of panels of knit fabric.

9. The stab resistant knit fabric of claim 8, which comprises 2 panels of knit fabric.

10. The stab resistant knit fabric of claim 8, which comprises 3 panels of knit fabric.

11. The stab resistant knit fabric of claim 8, which comprises 4 panels of knit fabric.

12. The stab resistant knit fabric of claim 8, which comprises 5 panels of knit fabric.

13. The stab resistant knit fabric of claim 8, which comprises 6 panels of knit fabric.

14. The stab resistant knit fabric of claim 8, having a stab resistance rating of L1,E2 in accordance with NIJ 0115.00.

15. The stab resistant knit fabric of claim 8, having a stab resistance rating of L2,E2 in accordance with NIJ 0115.00.

16. The stab resistant knit fabric of claim 9, having a stab resistance rating of L1,E2 in accordance with NIJ 0115.00.

17. The stab resistant knit fabric of claim 11, having a stab resistance rating of L2,E2 in accordance with NIJ 0115.00.

18. The stab resistant knit fabric of claim 1, wherein each panel of knit fabric is prepared from a composite yarn comprising a core and one or more wrap layers.

19. The stab resistant knit fabric of claim 18, wherein the core comprises at least one strand of fiberglass yarn and at least one strand of high performance yarn.

20. The stab resistant knit fabric of claim 18, wherein the one or more wrap layers comprise at least one member selected from the group consisting of polyester, nylon, high performance yam, fiberglass, natural fibers, and mixtures thereof.

21. The stab resistant knit fabric of claim 18, wherein the composite yarn further comprises wire.

22. The stab resistant knit fabric of claim 19, wherein the core further comprises wire.

23. The stab resistant knit fabric of claim 19, wherein the at least one strand of high performance yarn is at least one strand of olefin yarn.

24. The stab resistant knit fabric of claim 19, wherein the one or more wrap layers comprise a first wrap layer of polyester wrapped around the core, and a second wrap of polyester wrapped around a combination of the first wrap layer and core.

25. A protective garment prepared from the stab resistant knit fabric of claim 1.

26. A protective garment prepared from the stab resistant knit fabric of claim 8.

27. The protective garment of claim 25, wherein the protective garment is a member selected from the group consisting of aprons, gloves, shirts, pants, jumpsuits, vests, and arm coverings.

28. The protective garment of claim 26, wherein the protective garment is a member selected from the group consisting of aprons, gloves, shirts, pants, jumpsuits, vests, and arm coverings.

29. The protective garment of claim 27, wherein the protective garment is a vest.

30. The protective garment of claim 28, wherein the protective garment is a vest.

31. The protective garment of claim 25, wherein the garment is formed entirely from the stab resistant knit fabric, except for the closure system used to keep the garment in place on the wearer.

32. The protective garment of claim 26, wherein the garment is formed entirely from the stab resistant knit fabric, except for the closure system used to keep the garment in place on the wearer.

33. The stab resistant knit fabric of claim 8, wherein the fabric has ballistic resistance properties.

* * * * *